United States Patent [19]

Christensen et al.

[11] 4,289,807

[45] Sep. 15, 1981

[54] FUSION PROCESSING OF SYNTHETIC THERMOPLASTIC RESINOUS MATERIALS

[75] Inventors: Marvin M. Christensen, Baton Rouge; Richard E. Zachary, Clinton; Andra P. Dupont, Plaquemine, all of La.

[73] Assignee: The Dow Chemical Company, Midland, Mich.

[21] Appl. No.: 126,619

[22] Filed: Mar. 3, 1980

[51] Int. Cl.[3] ..... B05B 1/00; B05D 1/02; B05B 1/24; B05D 1/12

[52] U.S. Cl. ..... 427/195; 118/302; 118/312; 239/8; 239/13; 239/134; 239/139; 427/422

[58] Field of Search ..... 427/195, 422; 118/600, 118/302, 312; 239/8, 13, 133, 134, 139

[56] References Cited

U.S. PATENT DOCUMENTS

| | | | |
|---|---|---|---|
| 1,825,131 | 9/1931 | Shepherd | 239/8 |
| 1,971,804 | 8/1934 | Alexander | 118/302 |
| 2,101,922 | 12/1937 | Stoesling | 427/422 X |
| 2,355,225 | 8/1944 | MacWilliam | 427/422 |
| 2,511,797 | 6/1950 | Hochberg | 427/422 |
| 3,075,066 | 1/1963 | Yenni et al. | 118/302 |
| 3,677,471 | 7/1972 | Deakin | 239/133 X |
| 3,715,076 | 2/1973 | Kenderi | 427/422 X |
| 3,901,184 | 8/1975 | Payne et al. | 118/312 X |
| 3,958,758 | 5/1976 | Piorkowski | 427/422 X |

FOREIGN PATENT DOCUMENTS

| | | | |
|---|---|---|---|
| 2118216 | 7/1972 | France | 427/422 |
| 125778 | 4/1919 | United Kingdom | 427/422 |
| 348187 | 5/1931 | United Kingdom | 427/422 |

*Primary Examiner*—Shrive P. Beck
*Attorney, Agent, or Firm*—A. J. Young

[57] ABSTRACT

Apparatus and method for the fusion processing of synthetic thermoplastic resinous materials, utilizing a first high-velocity stream of gas to transport the resinous material through an elongated passageway which directs the stream of gas and transported material onto a workpiece, thereby fusing the resinous material. The elongated passageway is defined by at least one wall having a plurality of foramina or pores through which a second stream of gas is directed to heat the resinous material to a fusion temperature and to provide a slip stream on the inner surface of the wall thereby preventing the resinous material from sticking to the surface. The first stream of gas may be heated to initiate or supplement the heating of the resinous material.

10 Claims, 1 Drawing Figure

FUSION PROCESSING OF SYNTHETIC THERMOPLASTIC RESINOUS MATERIALS

BACKGROUND OF THE INVENTION

This invention relates to an apparatus and a method for the fusion processing of synthetic thermoplastic resinous materials. More particularly, the invention relates to the processing of a particulate synthetic thermoplastic resinous material by the use of a high-velocity stream of heated gas to transport the particulate synthetic thermoplastic resinous material through an elongated passageway which directs the stream of gas and particulate resinous material onto a workpiece, thereby causing the particulate resinous material to fuse onto the workpiece as a continuous mass.

It is known to mix a synthetic thermoplastic resinous material, in powder form, with a gas stream, which gas stream transports the material to a workpiece to be coated. Such a method depends on a flame or on excessive internal heating of the gas stream to melt the resinous material. Supplying heat in these ways often causes plugging of the apparatus or degradation of the resinous material. The present invention provides a means of processing particulate synthetic thermoplastic resinous materials without the use of a flame or excessive internal heating. The invention also provides a novel method of minimizing or eliminating plugging of the apparatus or premature sintering of the thermoplastic resin that is being processed. Other advantages dervied from this novel processing technique are greater versatility, simplicity of equipment design and operation, and lower capital costs.

SUMMARY

In general, this invention provides an apparatus for the fusion processing of particulate synthetic thermoplastic resinous materials. Suitable apparatus for the practice of this invention includes a means for providing a first stream of high-velocity gas; means for entraining a particulate synthetic thermoplastic resinous material in the first stream of gas; an elongated passageway for transporting the first stream of gas and entrained resinous material, the elongated passageway being defined by at least one wall having a plurality of foramina or small pores therethrough; means for providing and passing a second stream of heated gas through the foraminous wall into the elongated passageway, said wall terminating at an exit opening for expelling the first and second streams of gas and entrained resinous material from the apparatus; and a workpiece against which the entrained resinous material is directed, thereby fusing the particulate resinous material.

As a practical matter, almost any particulate thermoplastic synthetic polymeric resin can be fusion processed by the present apparatus. Beneficially, resins such as low or high density polyethylene, polypropylene, polyvinyl chloride, chlorinated polyethylene, acrylic polymers, polytetrafluoroethylene, including high and ultra high molecular weight polymers or the like can be fusion processed by the present apparatus. In addition, the particulate resin being processed may be initially heated in storage before entrainment in the first stream of gas or the first stream of gas may be heated to initiate or supplement the heating of the particulate resin. The only restriction on heating the resin at this point is that it cannot be heated to a temperature such that the particles of resin will sinter together or stick to the internal walls of the apparatus.

The first and second streams of gas may beneficially be air, steam, nitrogen, carbon dioxide or the like. The only limitation for the type of gases used is that they should be reasonably inert with respect to the resin being processed. In addition, the velocities of the first and second streams of gas may vary over a wide range. However, to be functional, the velocity of the first gas stream must be sufficient to entrain the particulate resin being processed. In addition, the second gas stream must be heated to a temperature sufficient to bring the particulate resin up to its fusion temperature and must have a sufficient velocity uniformly through the wall of the passageway to provide a slip stream next to the internal wall surface to prevent the resin from sticking to the wall and thereby plugging the passageway. Also, the velocity of the combined first and second streams of gas must be sufficient to impinge the entrained particulate resin on the workpiece.

Under normal process condition for the apparatus, the particulate resin being processed is impinged on the workpiece where it fuses into a continuous mass. However, the velocities of the gas streams and the temperature of the resin being processed may be regulated to provide a non-continuous sintered fusion mass of the resin on the workpiece. A sintered form of fusion product is most beneficially achieved when ultra-high molecular weight or intractable resins such as polytetrafluoroethylene are processed through the apparatus. The resin being processed in the apparatus may also be mixed with an inert filler such as clay, glass fibers or other natural fibers such as cotton or jute to form a heterogeneous fused product that cannot be easily obtained by other known apparatus or methods.

BRIEF DESCRIPTION OF THE DRAWING

The FIGURE is a schematic representation, with partial cutaway, of an apparatus which includes the essential elements of the present invention.

DESCRIPTION OF THE PREFERRED EMBODIMENTS

Figure 1:
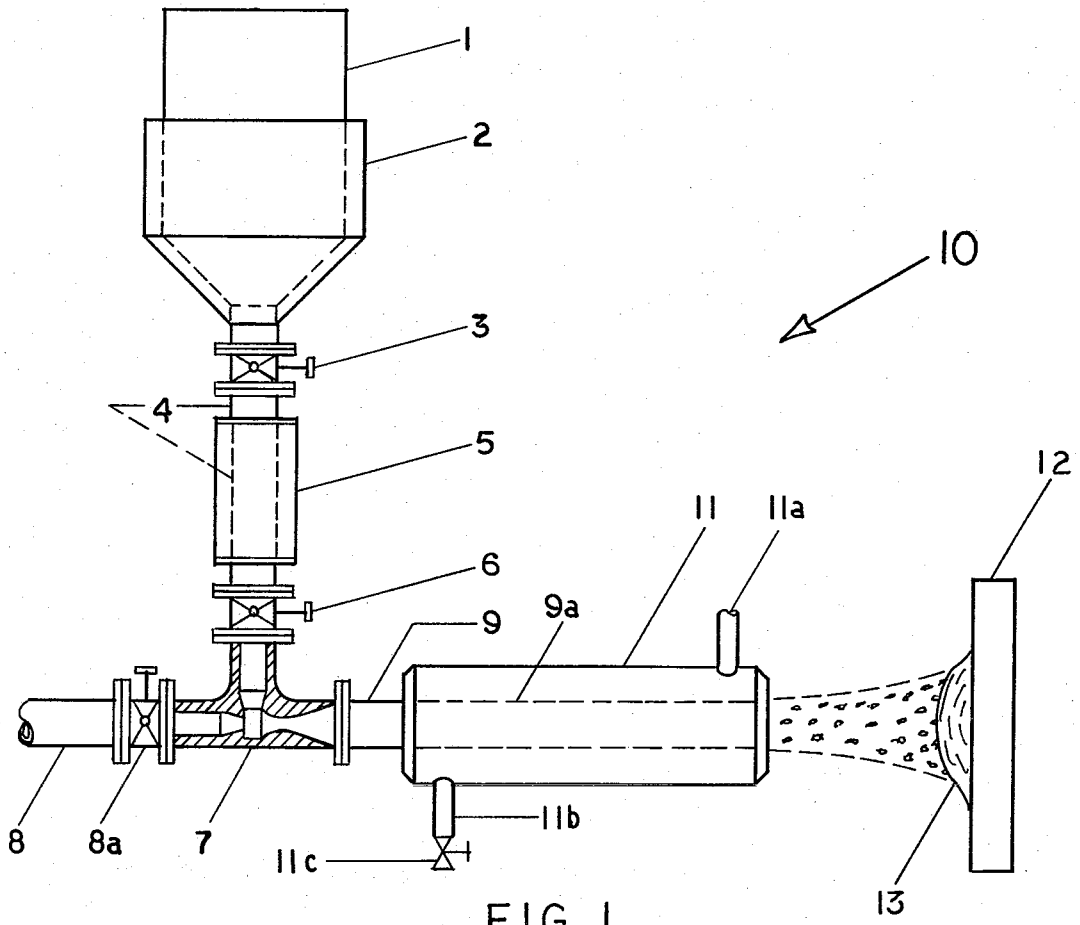

The following description illustrates the manner in which the principles of this invention are applied, but it is not to be construed as in any way limiting the scope of the invention.

More specifically, referring to FIG. 1, an apparatus 10 illustrates the essential elements for the fusion processing of particulate synthetic thermoplastic resinous materials, or of mixtures of such materials with other materials which are, of themselves, infusible.

The apparatus 10 includes a hopper 1 heated by a jacket-type steam heater 2, a flow-control valve 3 for regulating the rate of flow of the particulate thermoplastic material from the hopper 1 through a conduit 4 with a juxtaposed heater 5 for further heating the material, and a suction-control valve 6 for controlling the rate of flow of the particulate thermoplastic material into a stream of gas flowing through a conduit 8 which is regulated by a regulating valve 8*a*. The gas stream, which is moving with a relatively high velocity, entrains the thermoplastic material and transports it by means of a jet ejector 7 through a connecting pipe or tube 9 which has a foraminous elongated pipe section 9*a* enclosed by a steam-heated chamber 11. Upon leaving the section 9*a* the entrained particulate resin strikes a workpiece 12, thereby fusing the particulate resin into a solid mass 13. The chamber 11 is provided with a pipe 11*a* for admitting steam and a pipe 11*b* for venting steam or condensate through valve 11*c*.

The apparatus and method just described can be used to polymer-coat a workpiece. Alternatively, the apparatus and method can be used to mold a thermoplastic into a desired shape or form. Such forms or coatings can be solid or sintered, depending upon the operating conditions. A further application is the preparation of thermoplastic films. A still further application is the incorporation of an inert filler material, which of itself is infusible and therefore not susceptible to fusion processing, into the thermoplastic material that is processed and fused. In all such applications, as well as others which will occur to those skilled in the art, the use of this invention permits processing the resinous materials at lower temperatures than in known conventional methods, thereby minimizing oxidative and thermal degradation.

In the preferred method of practicing this invention, superheated steam is used as the gas which provides kinetic and thermal energy for heating and transporting the particulate resinous material. In the construction of the apparatus 10, a foraminous or porous material, such as a sintered porous metal, which is permeable to steam, is used to make pipe section 9*a*. The pressure of the steam in the chamber 11 is maintained at a uniform pressure throughout the length of section 9*a* and above that of the pressure within the passageway formed by section 9*a*. This technique provides a uniform flow of steam from the chamber 11 to the passageway formed by section 9*a*, thereby providing a slip stream that minimizes or eliminates the tendency of the heated particulate resin to adhere to the inner surface of the wall of section 9*a*. The use of superheated steam as the heated gas allows the steam to act as a source of heat as well as a carrier for the particulate resinous material. The resin being processed is preferably in the form of a finely divided powder as it is fed from the hopper 1.

While certain representations and details have been described for the purpose of illustrating the present invention, it will be apparent to those skilled in the art that various changes and modifications can be made therein without departing from the spirit and scope of the invention.

What is claimed is:

1. An apparatus for the fusion processing of a particulate synthetic thermoplastic resinous material comprising, means for providing a first stream of high-velocity gas; means for entraining the particulate synthetic thermoplastic resinous material in the first stream of gas; an elongated passageway for transporting the first stream of gas and entrained resinous material, the passageway being defined by at least one wall having a plurality of formamina or small pores therethrough and throughout substantially the length thereof; means for providing and passing a second stream of heated gas through the foraminous wall into the passageway, said second stream having sufficient velocity uniformly through the wall to provide a slip stream next to the passageway surface of the wall thereby minimizing sticking of the resinous material to the passageway surface of the wall, said wall terminating at an exit opening for expelling the first and second streams of gas and entrained resinous material from the apparatus; and a workpiece against which the entrained resinous material is directed, thereby fusing the resinous material.

2. The apparatus of claim 1 wherein, the first stream of gas is heated to initiate or supplement the heating of the resinous material.

3. The apparatus of claim 2 wherein, the first stream of gas is steam.

4. The apparatus of claim 1 wherein, the second stream of gas is steam.

5. The apparatus of claim 1 wherein, the wall is formed from porous sintered metal.

6. The apparatus of claim 1 wherein, the apparatus includes means for heating the resinous material before it is entrained in the first stream of gas.

7. A method for the fusion processing of a particulate synthetic thermoplastic resinous material, which comprise the steps of:

a. providing a first stream of high-velocity gas, b. entraining the particulate synthetic thermoplastic resinous material in the first stream of gas, c. transporting the first stream of gas and entrained resinous material through an elongated passageway, said passageway being defined by at least one wall having a plurality of foramina or small pores therethrough and throughout substantially the length thereof, d. providing and passing a second stream of heated gas into the elongated passageway, said second stream having sufficient velocity uniformly through the wall to provide a slip stream next to the passageway surface of the wall thereby minimizing sticking of the resinous material to the passageway surface of the wall and to provide heating the entrained resinous material to a fusion temperature, and e. directing the entrained resinous material against a workpiece, thereby fusing the resinous material.

8. The method of claim 7 wherein, the first stream of gas is heated to initiate or supplement the heating of the resinous material.

9. The method of claim 8 wherein, the first stream of gas is steam.

10. The method of claim 7 wherein, the second stream of gas is steam.

* * * * *